US011324257B2

(12) United States Patent
Liu

(10) Patent No.: US 11,324,257 B2
(45) Date of Patent: May 10, 2022

(54) ELECTRONIC CIGARETTE COMPRISING MESHED HEATING DISC

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 473 days.

(21) Appl. No.: 15/865,293

(22) Filed: Jan. 9, 2018

(65) Prior Publication Data

US 2019/0069598 A1 Mar. 7, 2019

(30) Foreign Application Priority Data

Sep. 6, 2017 (CN) ..... 201710795777.5
Sep. 6, 2017 (CN) ..... 201721137045.9

(51) Int. Cl.
*A24F 40/46* (2020.01)
*A24F 40/485* (2020.01)
*A24F 40/10* (2020.01)

(52) U.S. Cl.
CPC ..... *A24F 40/46* (2020.01); *A24F 40/485* (2020.01); *A24F 40/10* (2020.01)

(58) Field of Classification Search
CPC ..... A24F 40/40; A24F 47/008
USPC ..... 131/330
See application file for complete search history.

(56) References Cited

U.S. PATENT DOCUMENTS 9,999,251 B2 * 6/2018 Liu ..... A24F 47/00
10,238,147 B2 * 3/2019 Li ..... A24F 47/008
10,555,556 B2 * 2/2020 Malgat ..... A24F 47/008
10,612,770 B2 * 4/2020 Meinhart ..... A24F 40/40
2014/0123989 A1 * 5/2014 LaMothe ..... H05B 3/06 131/328
2015/0027455 A1 * 1/2015 Peleg ..... A24F 40/30 131/328
2016/0000145 A1 * 1/2016 Liu ..... A61M 15/06 131/329
2016/0338410 A1 * 11/2016 Batista ..... A24F 47/008
2018/0206554 A1 * 7/2018 Jiang ..... A24F 47/008
2018/0360123 A1 * 12/2018 Silvestrini ..... A24F 47/002

* cited by examiner

*Primary Examiner* — Kelly M Gambetta
*Assistant Examiner* — Russell E Sparks
(74) *Attorney, Agent, or Firm* — Matthias Scholl P.C.; Matthias Scholl

(57) ABSTRACT

An electronic cigarette, including: a cigarette holder assembly; a threaded sleeve; a meshed heating disc; e-liquid conducting cotton; an e-liquid load module; and a base assembly. The cigarette holder assembly includes a cigarette holder, an air adjusting ring, and a threaded gasket. The air adjusting ring includes a bottom wall and is embedded in the cigarette holder. The threaded gasket is in threaded connection to the air adjusting ring, and a plurality of holes is disposed in the bottom wall of the air adjusting ring. The e-liquid load module includes a cotton support, an e-liquid feeding hopper, a compression ring, a telescopic column, a spring, an anode connecting piece and an end plug. The spring, the telescopic column, the compression ring and the e-liquid feeding hopper are mounted in the anode connecting piece in that order. The cotton support is embedded in the anode connecting piece.

4 Claims, 13 Drawing Sheets

ELECTRONIC CIGARETTE COMPRISING MESHED HEATING DISC

CROSS-REFERENCE TO RELATED APPLICATIONS

Pursuant to 35 U.S.C. § 119 and the Paris Convention Treaty, this application claims foreign priority benefits to Chinese Patent Application No. 201710795777.5 filed Sep. 6, 2017, and to Chinese Patent Application No. 201721137045.9 filed Sep. 6, 2017. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The disclosure relates to an electronic cigarette comprising a meshed heating disc.

Description of the Related Art

Typically, the heating element of an electronic cigarette employs a heating coil, which has a relatively low power and thus produces a small amount of vapor. This leads to poor user experience (e.g., bad taste).

SUMMARY OF THE INVENTION

In view of the above-described problems, it is one objective of the invention to provide an electronic cigarette comprising a meshed heating disc. The meshed heating disc comprises a composite series-connection and parallel-connection circuit, which can atomize much more e-liquid per unit time, thus increasing the amount of vapor.

To achieve the above objectives, in accordance with one embodiment of the invention, there is provided an electronic cigarette, comprising: a cigarette holder assembly; a threaded sleeve; a meshed heating disc; e-liquid conducting cotton; an e-liquid load module; and a base assembly. The cigarette holder assembly comprises a cigarette holder, an air adjusting ring, and a threaded gasket; the air adjusting ring comprises a bottom wall and is embedded in the cigarette holder; the threaded gasket is in threaded connection to the air adjusting ring, and a plurality of holes is disposed in the bottom wall of the air adjusting ring; the e-liquid load module comprises a cotton support, an e-liquid feeding hopper, a compression ring, a telescopic column, a spring, an anode connecting piece and an end plug; the spring, the telescopic column, the compression ring and the e-liquid feeding hopper are mounted in the anode connecting piece in that order; the cotton support is embedded in the anode connecting piece; the e-liquid conducting cotton, the meshed heating disc and the threaded sleeve cooperate with one another; the threaded sleeve is in an interference fit with the anode connecting piece; four ventilation holes are formed in the threaded sleeve; and the base assembly comprises a glass tube, a first seal ring, a second seal ring, a third seal ring, a base, an insulating piece and an electrode; the insulating piece is arranged in the base; the anode connecting piece passes through the insulating piece, combines with the electrode, and then is fixed on the base; the first, second and third seal rings are all arranged on the base; the first seal ring, the second seal ring and the third seal ring cooperate with the glass tube; the base comprises an upper thread ring integrated with the base, and the upper thread ring serves as a cathode of the meshed heating disc after being electrified.

In a class of this embodiment, the meshed heating disc is circular and made of metal material and contains a composite series-connection and parallel-connection circuit.

In a class of this embodiment, six holes are evenly distributed in the bottom wall of the air adjusting ring.

In accordance with another embodiment of the invention, there is provided an electronic cigarette, comprising: a cigarette holder assembly; an atomization module; an e-liquid load module; and a base assembly. The cigarette holder assembly, the atomization module, the e-liquid load module, and the base assembly are connected in that order; the cigarette holder assembly comprises a cigarette holder, an air adjusting ring, a seal ring, an upper cover comprising a groove, a gas blocking ring, and a threaded gasket; the seal ring is arranged in the groove of the upper cover, the air adjusting ring sleeves the upper cover, the gas blocking ring is screwed up in the threaded gasket and inserted into the upper cover; the cigarette holder and the upper cover are in sealing connection; the atomization module comprises a seal ring, an atomizing cover, a meshed heating disc, e-liquid conducting cotton, a cotton support, an insulating ring, and a fixed ring for fixing the meshed heating disc; the insulating ring is embedded in the cotton support, the fixed ring is embedded in the insulating ring, the e-liquid conducting cotton and the meshed heating disc are mounted on the cotton support, and the seal ring is mounted in a groove of the atomizing cover, and then is integrated with the cotton support; the e-liquid load module comprises an e-liquid feeding hopper, a first anode connecting piece, a seal ring, a spring, a telescopic column, a second anode connecting piece and an end plug; the end plug is mounted on the second anode connecting piece, the spring is arranged in the telescopic column and then is inserted into the first anode connecting piece; the seal ring is embedded in the second anode connecting piece, the e-liquid feeding hopper is mounted into the first anode connecting piece, the threaded sleeve sleeves the first anode connecting piece; the end plug cooperates with the second anode connecting piece to prevent the leakage of the e-liquid; the threaded sleeve combines with the anode connecting piece; and the base assembly comprises a glass tube, a first seal ring, a second seal ring, a third seal ring, a base, an insulating piece and an electrode; the insulating piece is arranged in the base; the anode connecting piece passes through the insulating piece, combines with the electrode, and then is fixed on the base; the first, second and third seal rings are all arranged on the base; the first seal ring, the second seal ring and the third seal ring cooperate with the glass tube; the base comprises an upper thread ring integrated with the base, and the upper thread ring serves as a cathode of the meshed heating disc after being electrified.

In a class of this embodiment, the meshed heating disc is circular and made of metal material and contains a composite series-connection and parallel-connection circuit.

In a class of this embodiment, six holes are evenly distributed in the bottom wall of the air adjusting ring.

Advantages of the electronic cigarette of the disclosure are summarized as follows. The components of the electronic cigarette are matched with one another. The end plug cooperates with the second anode connecting piece to prevent the leakage of the e-liquid. The cotton support is embedded in the anode connecting piece. The threaded sleeve combines with the anode connecting piece so that the contact of the anode end and the meshed heating disc is firmer. The e-liquid conducting cotton and the meshed heating disc can be taken down and replaced directly after the threaded sleeve is unloaded. Four ventilation holes are formed in the threaded sleeve, which is conducive to improving the flow rate and volume of vapor, and also accelerates the loading of the e-liquid. The meshed heating disc is circular and made of metal material, and contains a composite series-connection and parallel-connection circuit, increasing the heating power. When the atomization module is electrified, the current is generated from the fixed ring, flows to the outer circle from the inner circle of the meshed heating disc and converges with the cathode where the heat is generated. The meshed heating disc is high in power and thus produces a large amount of vapor.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing an electronic cigarette comprising a meshed heating disc are described below.

Figure 1:
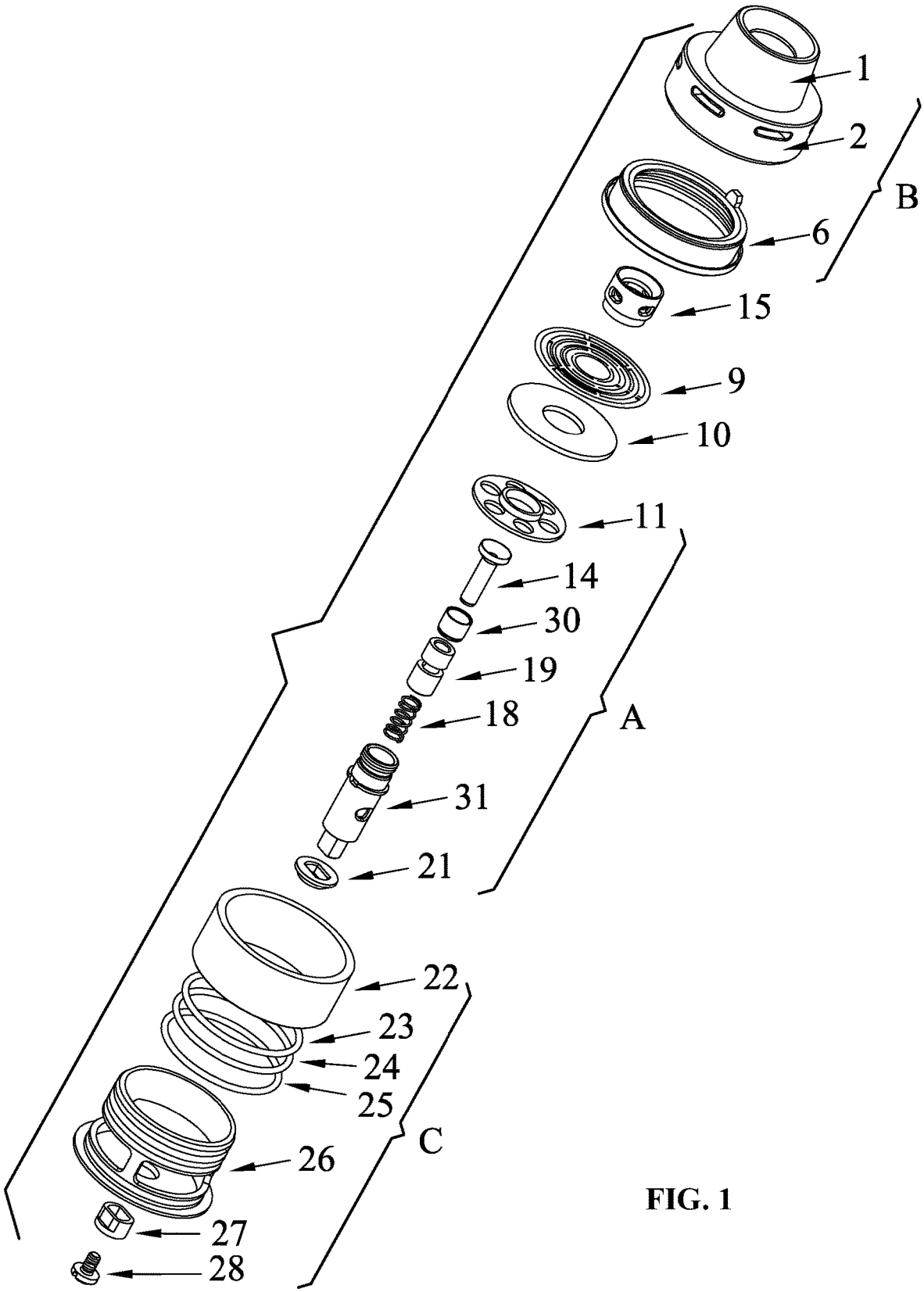
FIG. 1 is an exploded view of an electronic cigarette comprising a meshed heating disc according to one embodiment of the disclosure.
Figure 2:
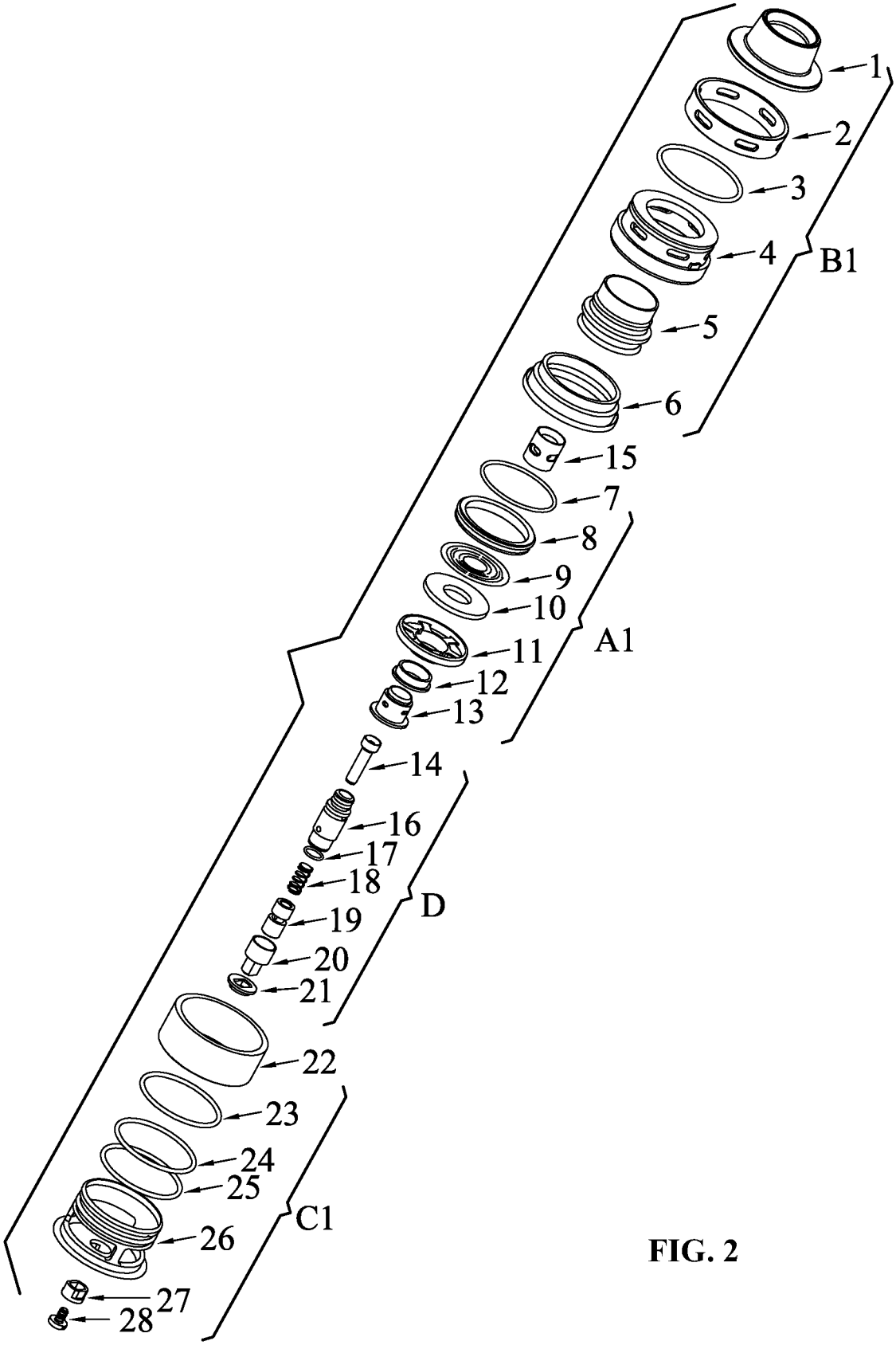
FIG. 2 is another exploded view of an electronic cigarette comprising a meshed heating disc according to one embodiment of the disclosure.
Figure 3:
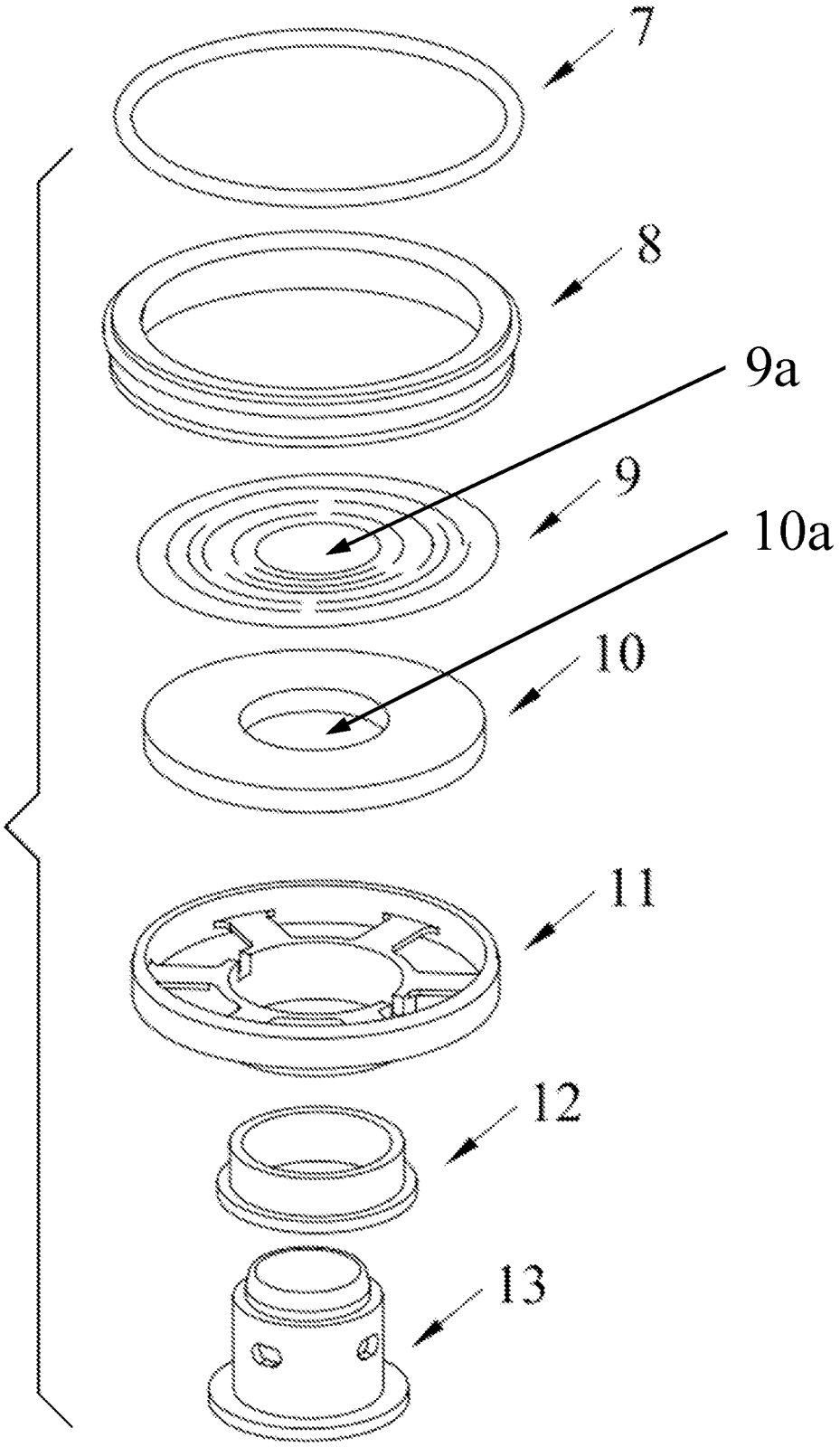
FIG. 3 is an exploded view of an atomization module of an electronic cigarette comprising a meshed heating disc according to one embodiment of the disclosure.
Figure 4A:
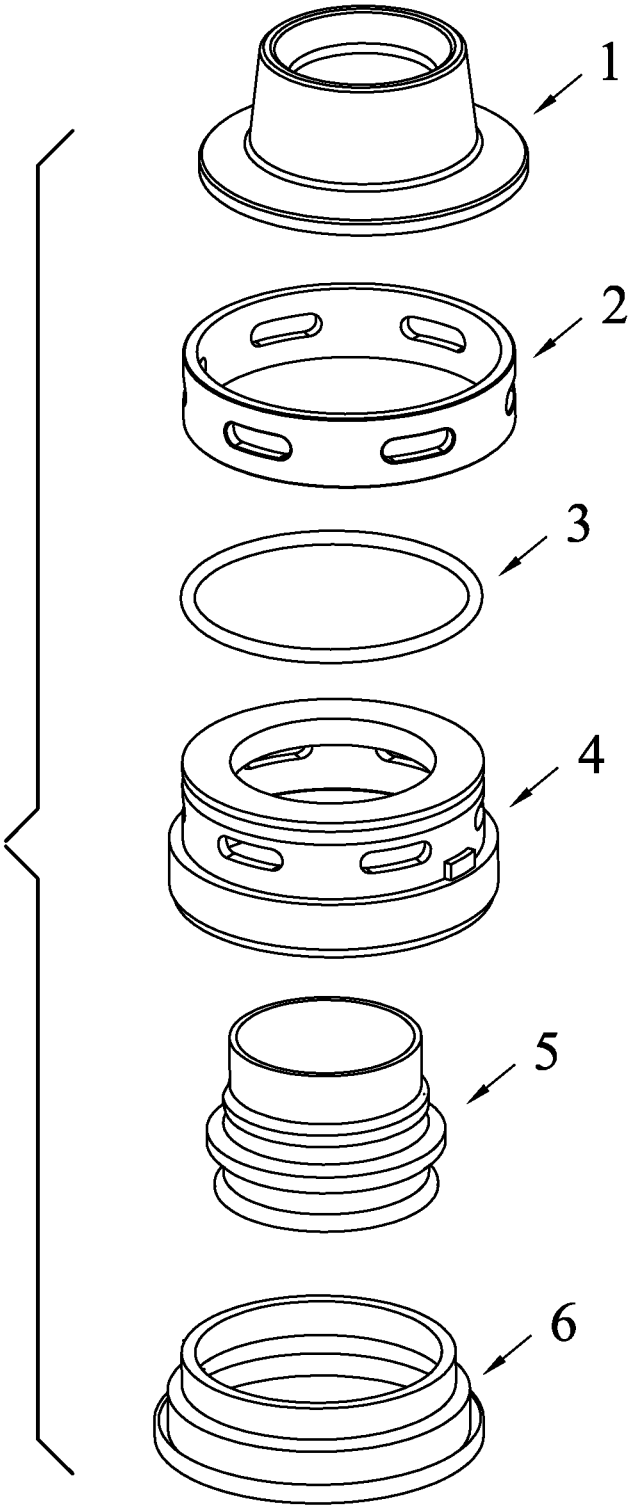
FIGS. 4A-4B are exploded views of a cigarette holder assembly of an electronic cigarette comprising a meshed heating disc according to one embodiment of the disclosure.
Figure 4B:
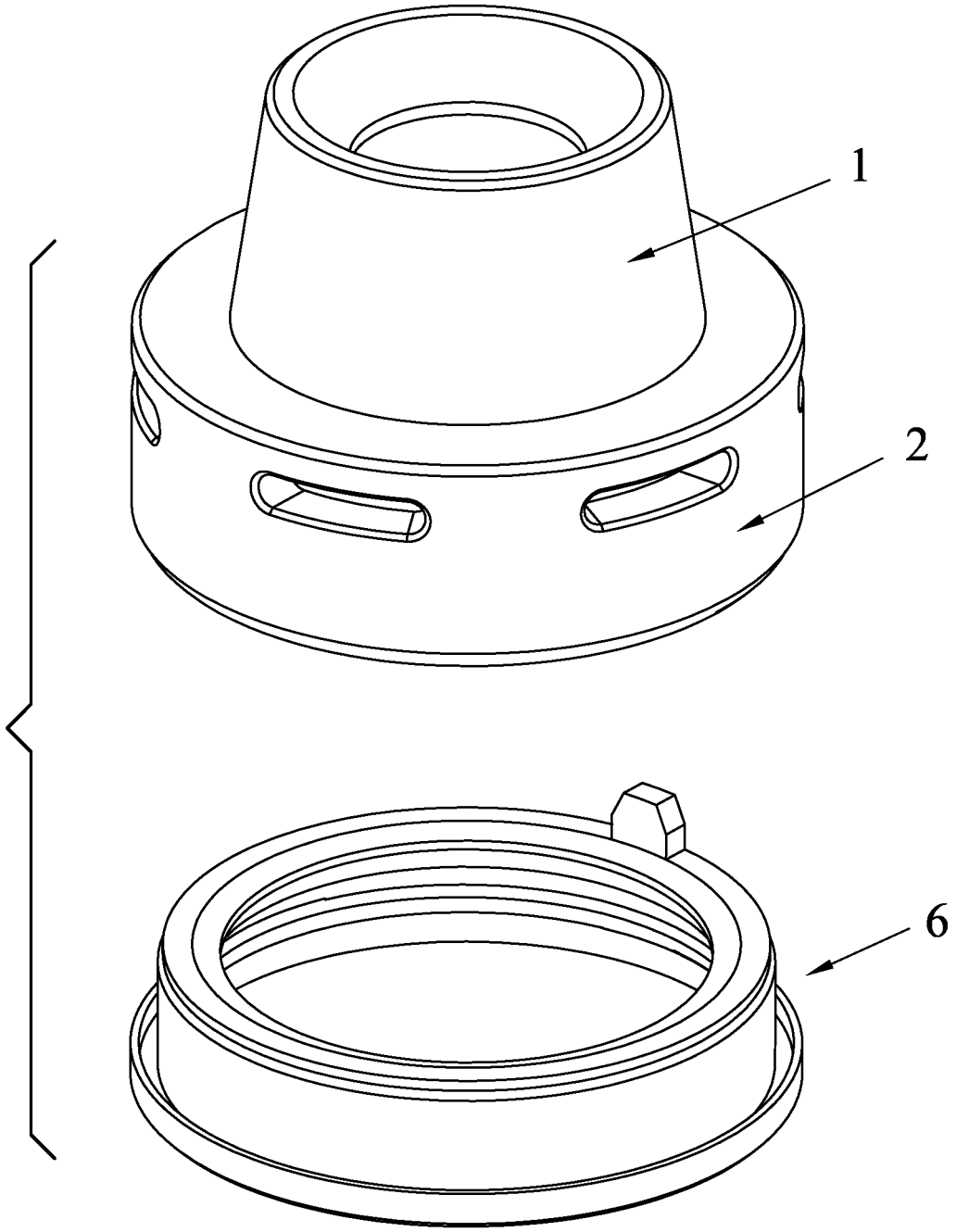
Figure 5A:
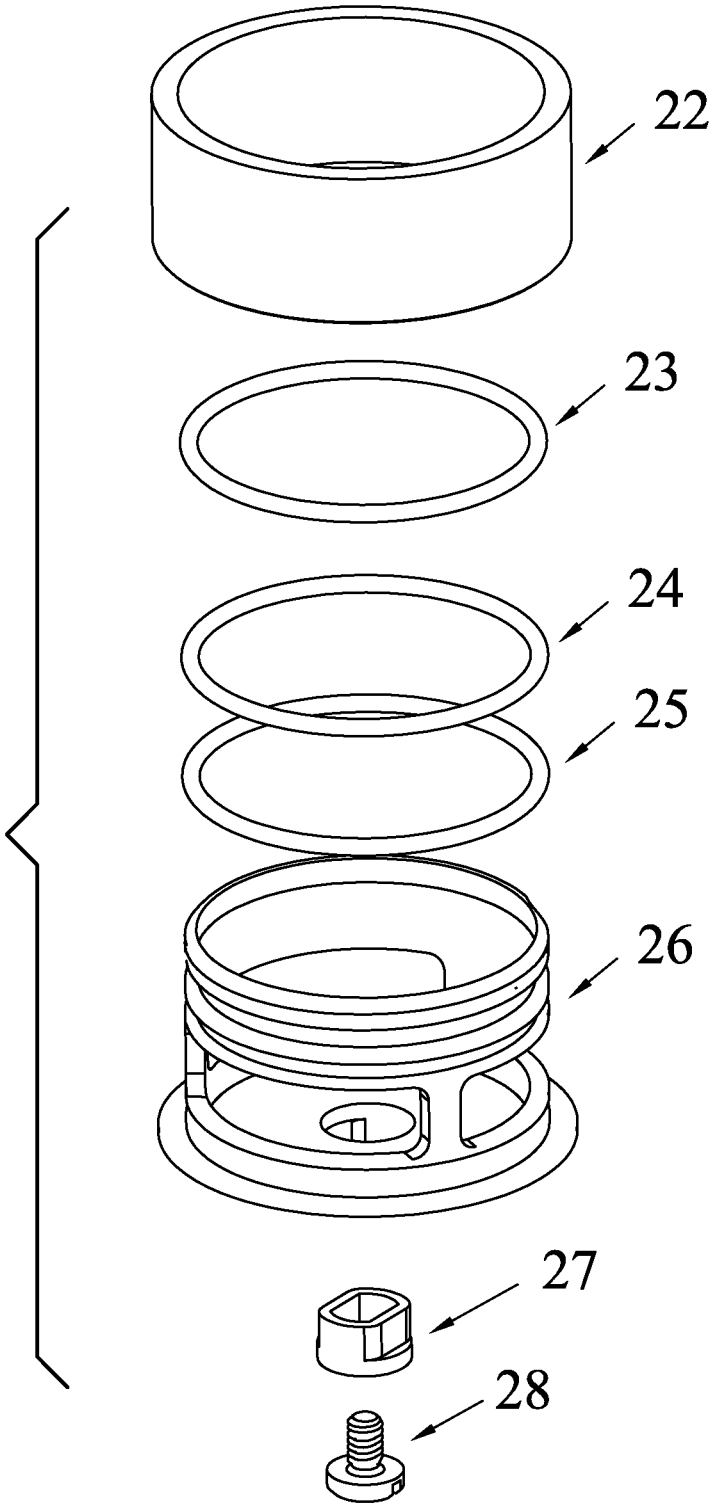
FIGS. 5A-5B are exploded views of a base assembly of an electronic cigarette comprising a meshed heating disc according to one embodiment of the disclosure.
Figure 5B:
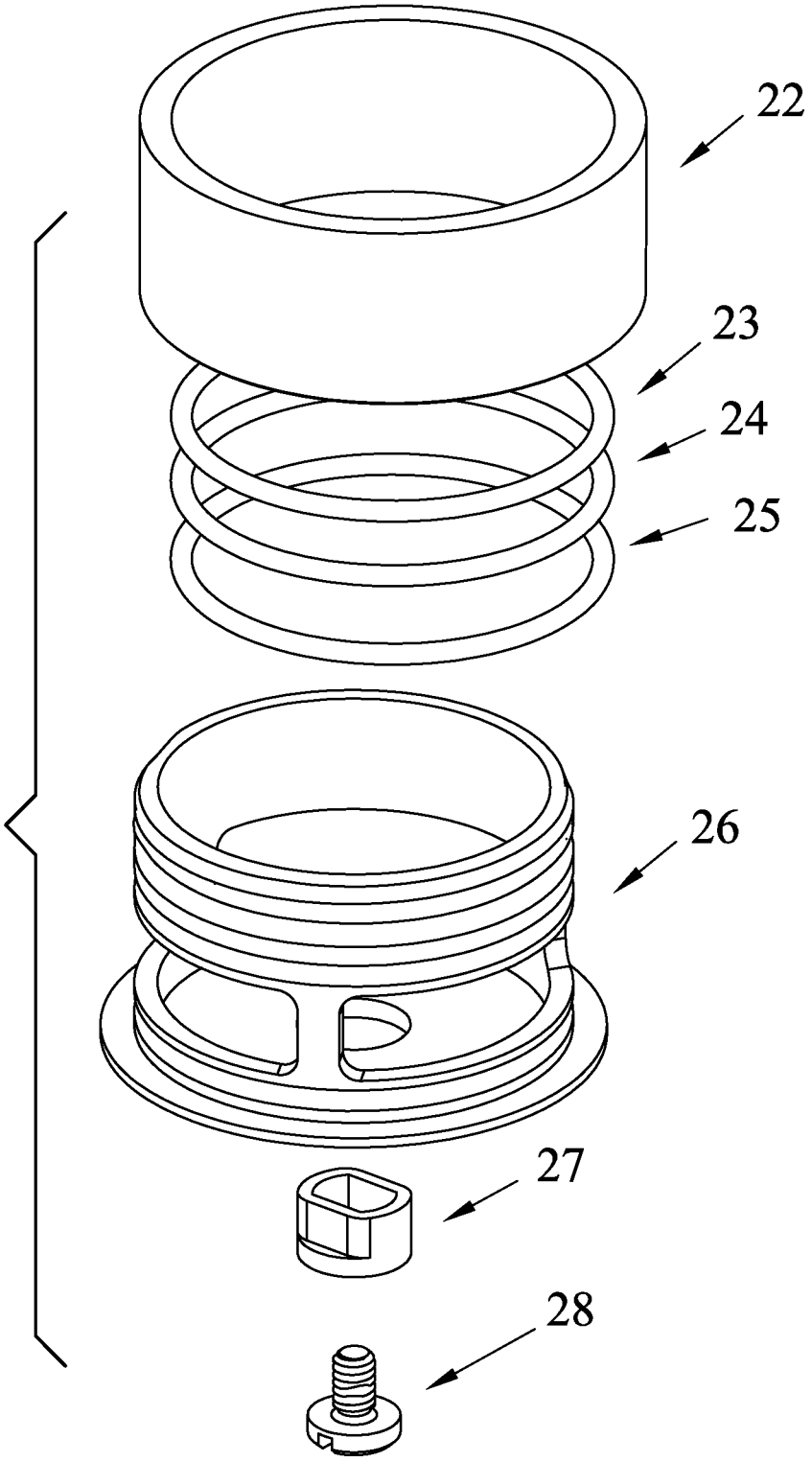
Figure 6A:
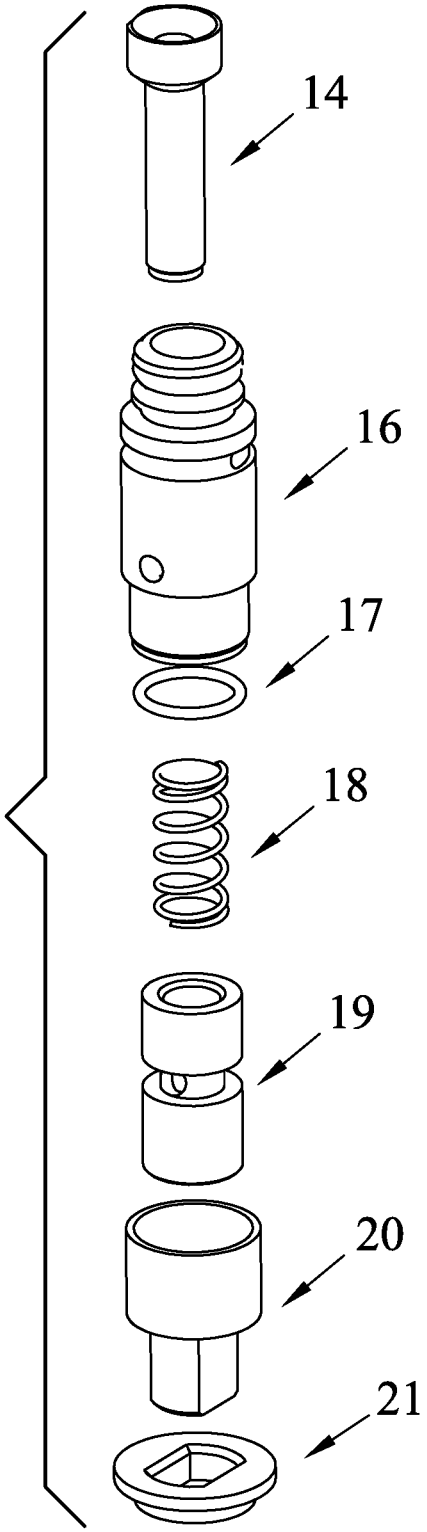
FIGS. 6A-6B are exploded views of an e-liquid load module of an electronic cigarette comprising a meshed heating disc according to one embodiment of the disclosure.
Figure 6B:
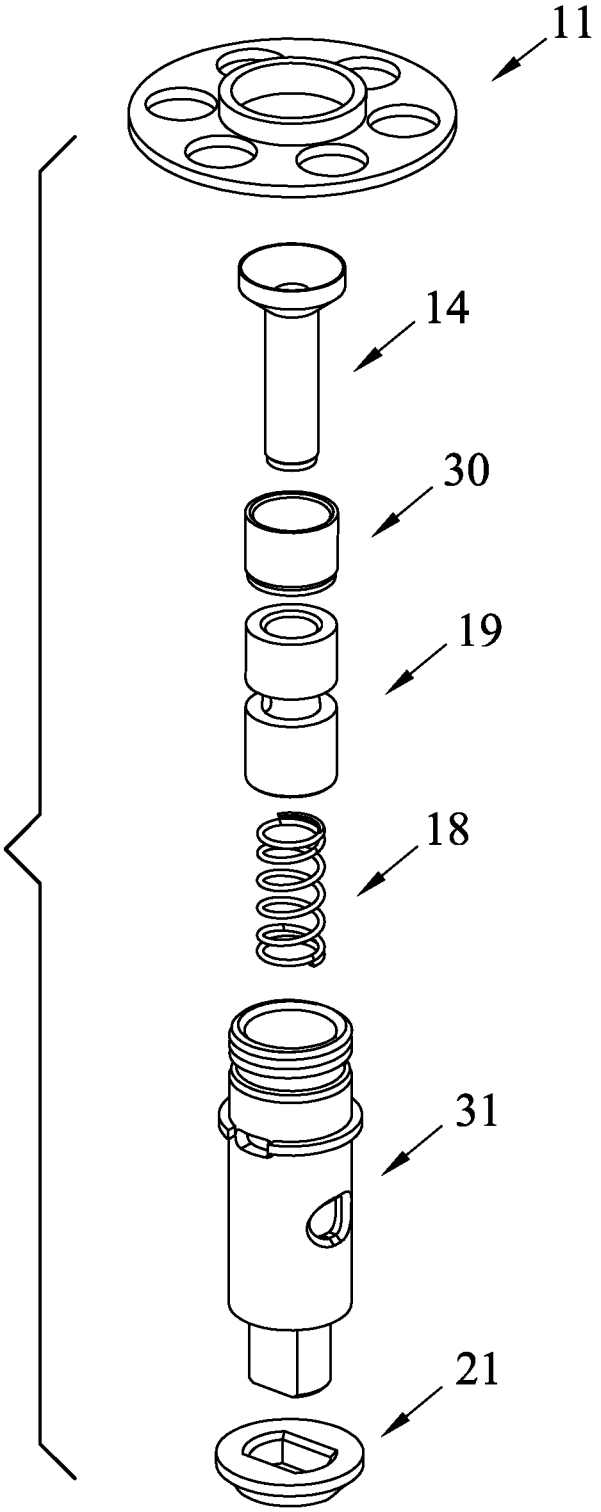
Figure 7A:
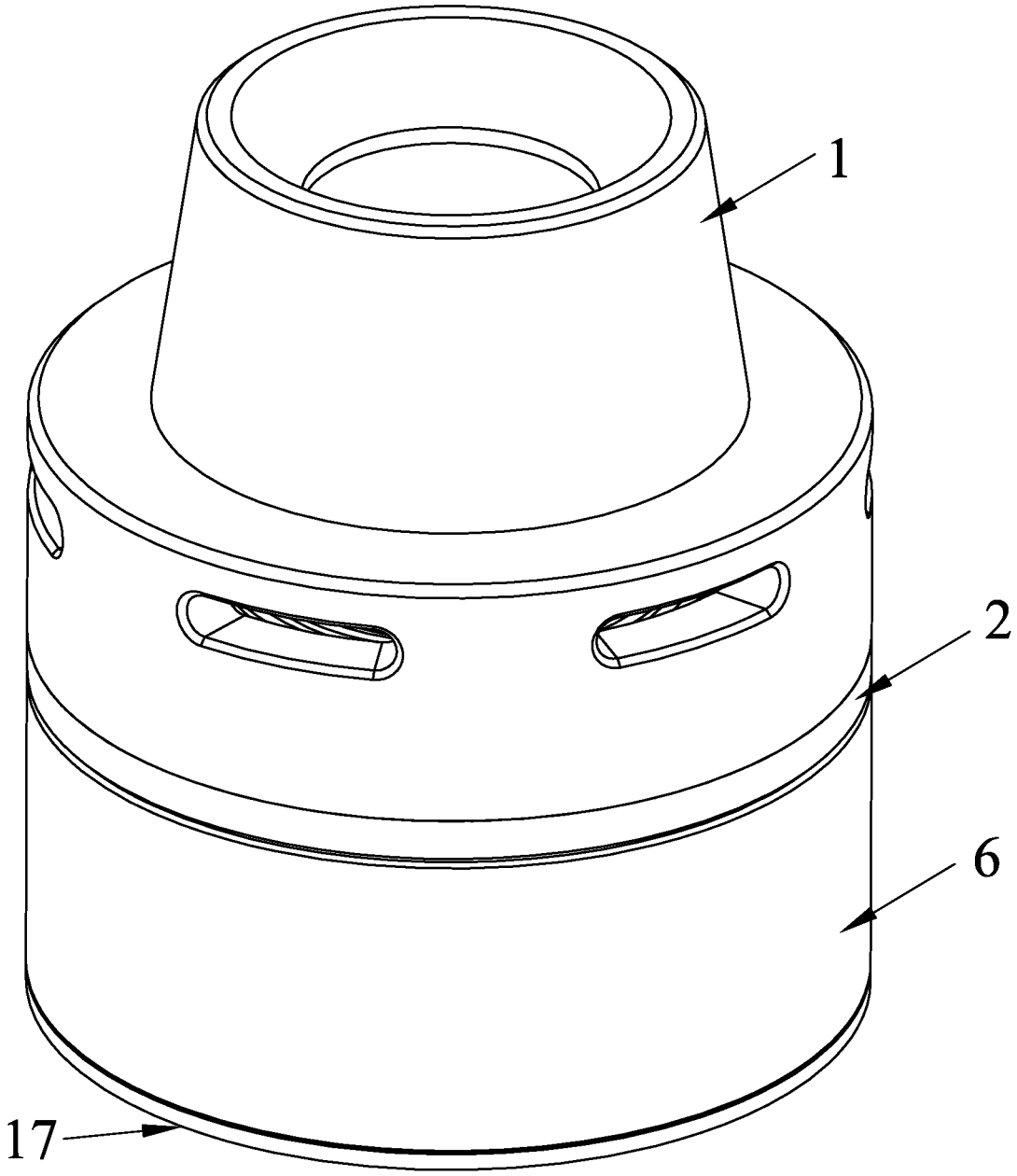
FIGS. 7A-7B are stereograms of a cigarette holder assembly of an electronic cigarette comprising a meshed heating disc according to one embodiment of the disclosure.
Figure 7B:
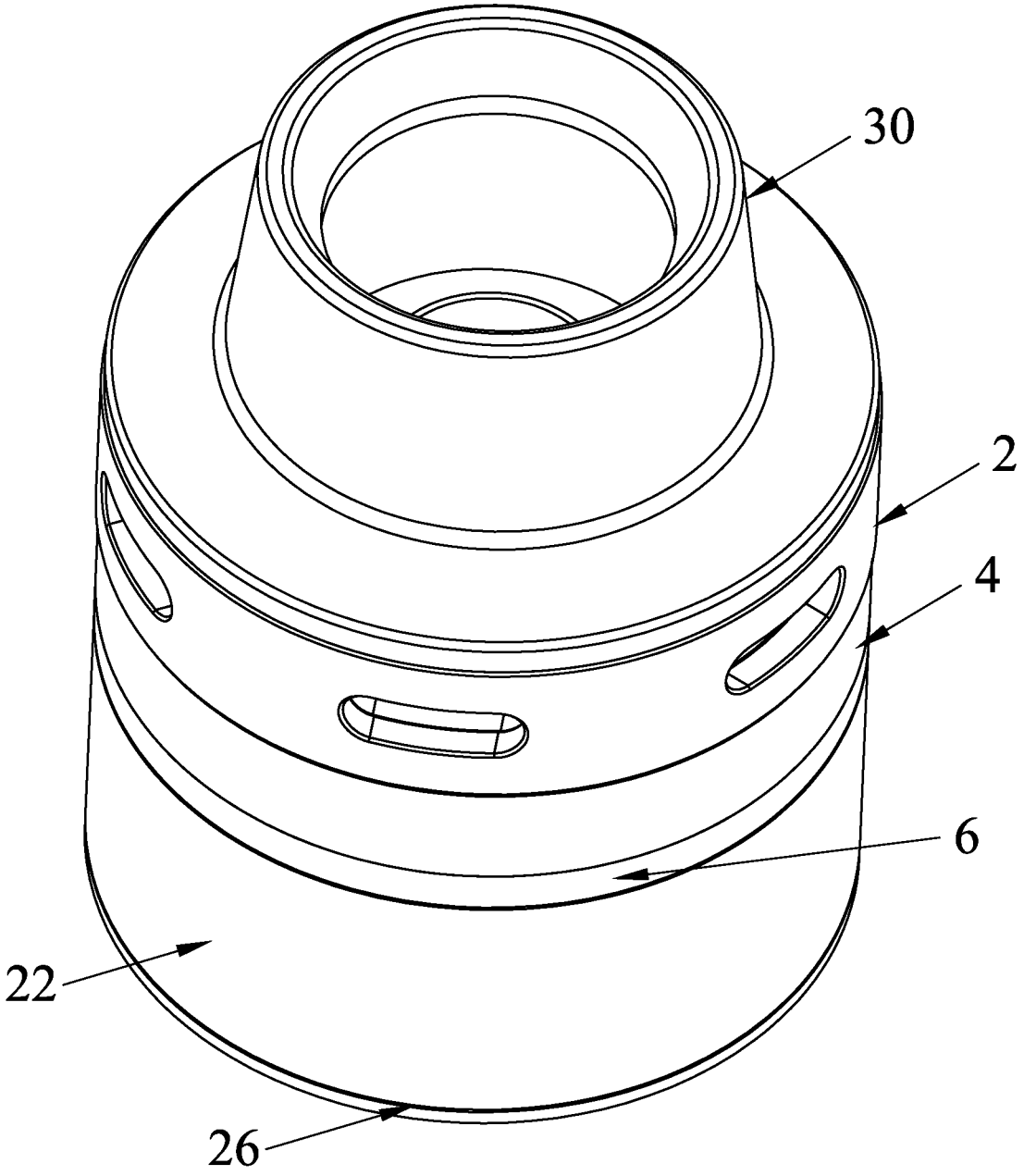
Figure 8A:
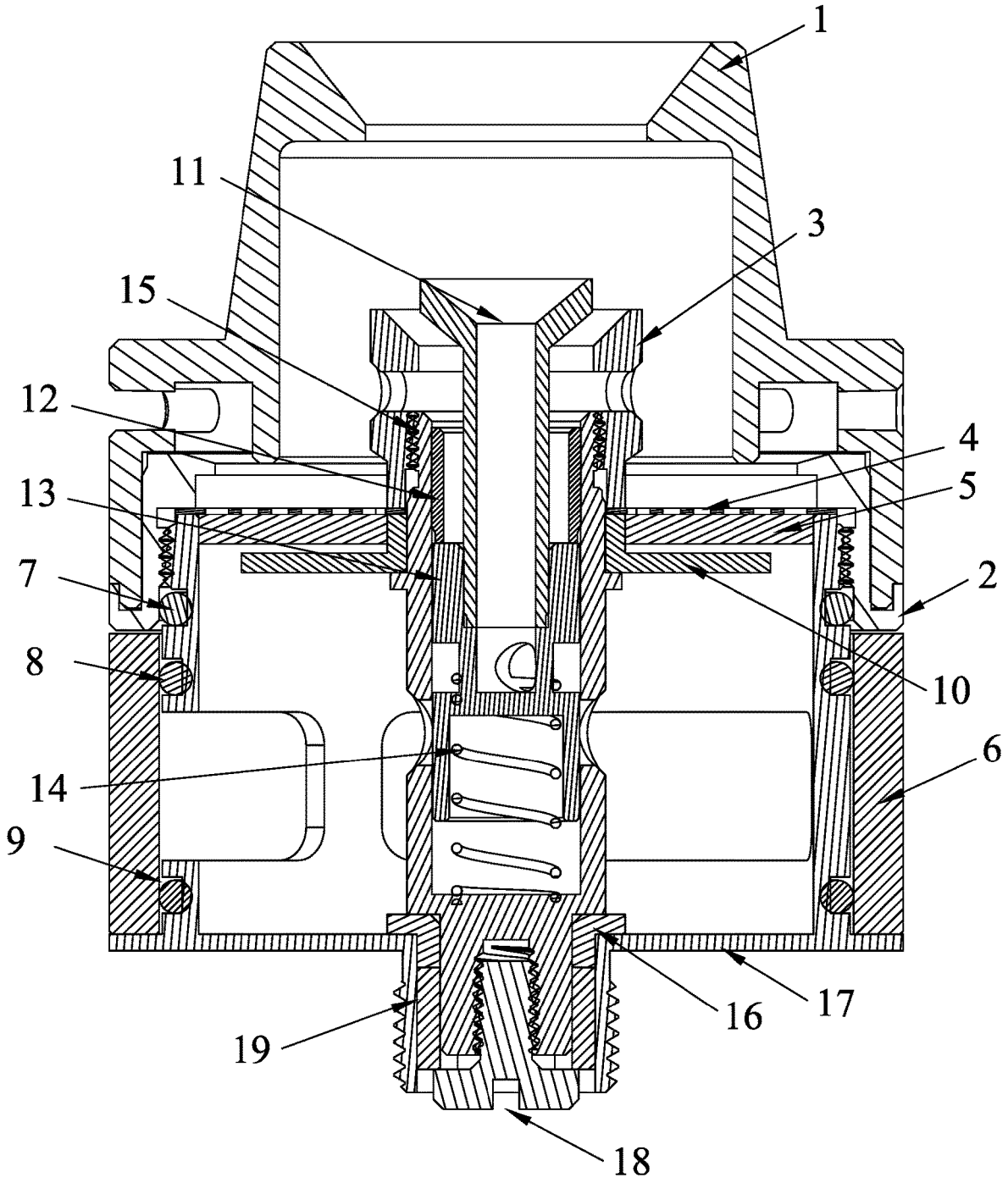
FIGS. 8A-8B are sectional view of an electronic cigarette comprising a meshed heating disc according to one embodiment of the disclosure.
Figure 8B:
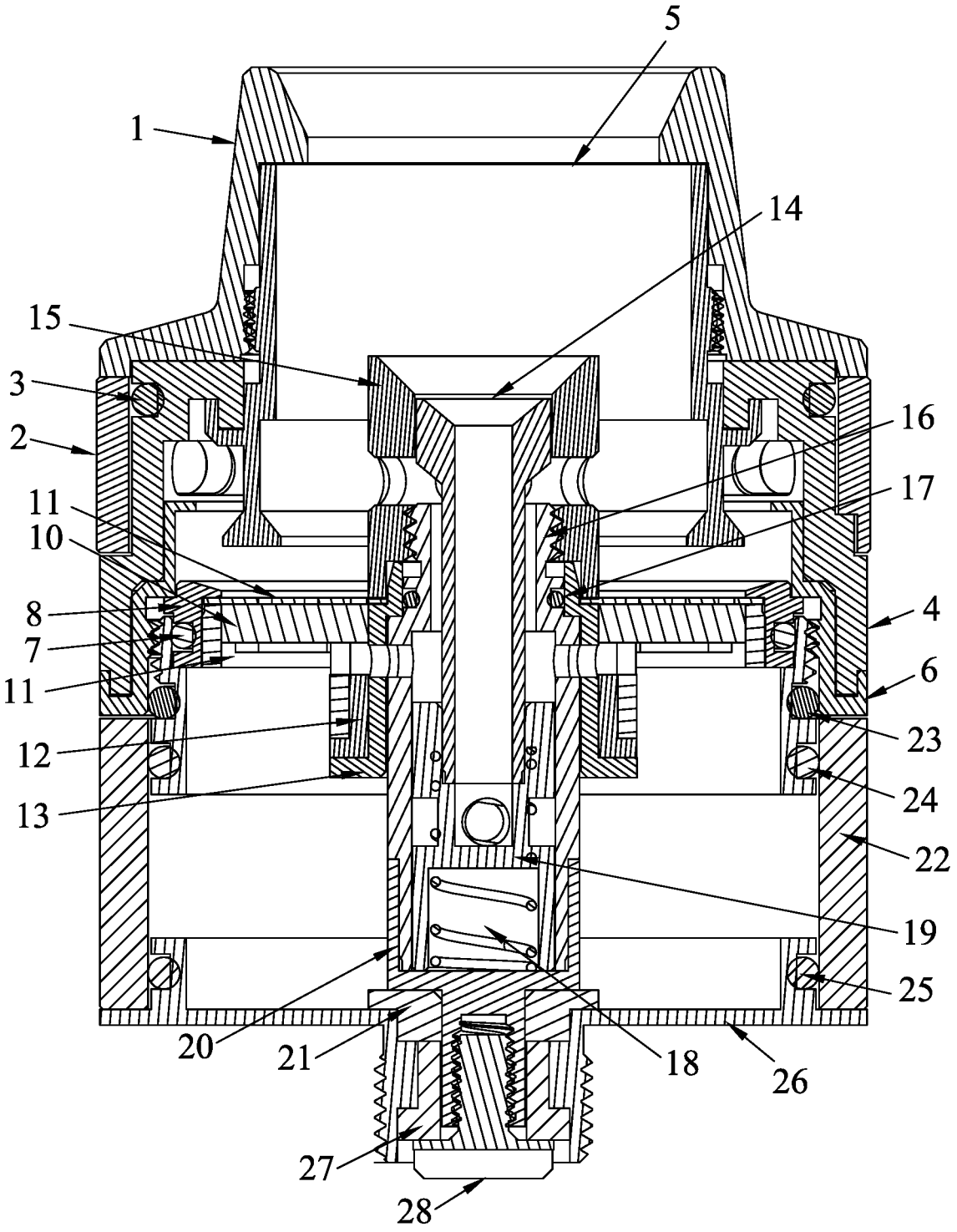

As shown in FIGS. 1, 2, . . . 8A, and 8B, an electronic cigarette comprises a cigarette holder assembly B, a threaded sleeve 15, a meshed heating disc 9, e-liquid conducting cotton 10, an e-liquid load module A and a base assembly C.

The cigarette holder assembly B comprises a cigarette holder 1, an air adjusting ring 2 and a threaded gasket 6; the air adjusting ring 2 is embedded in the cigarette holder 1, the threaded gasket 6 is in threaded connection to the air adjusting ring 2, and a plurality of holes is disposed in the bottom of the air adjusting ring 2, which is conducive to produce smooth vapor flow during inhaling.

The e-liquid load module A comprises a cotton support 11, an e-liquid feeding hopper 14, a compression ring 30, a telescopic column 19, a spring 18, an anode connecting piece 31 and an end plug 21. The spring 18, the telescopic column 19, the compression ring 30 and the e-liquid feeding hopper 14 are mounted in the anode connecting piece 31 in that order, the components are matched with one another to generate upward elastic force, and the elastic force determines an e-liquid conduction hole in the telescopic column 19 to move up and down, thus opening or closing the e-liquid conduction hole. The end plug 21 cooperates with the anode connecting piece 31 to prevent the leakage of the e-liquid. The cotton support 11 is embedded in the anode connecting piece 31. The three elements, i.e., the e-liquid conducting cotton 10, the meshed heating disc 9 and the threaded sleeve 15, cooperate with one another. The threaded sleeve 15 combines with the anode connecting piece 31 so that the contact of an anode end and the meshed heating disc 9 is firmer, the e-liquid conducting cotton 10 and the meshed heating disc 9 can be taken down and replaced directly after the threaded sleeve 15 is dismantled by a user, four ventilation holes are formed in the threaded sleeve 15, which is conducive to improving the flow rate and volume of vapor, and also accelerates the loading of the e-liquid. The meshed heating disc 9 is circular and made of metal material and contains a composite series-connection and parallel-connection circuit, and the meshed heating disc 9 can enable current to move directionally in the circuit.

The base assembly C comprises a glass tube 22, a first seal ring 23, a second seal ring 24, a third seal ring 25, a base 16, an insulating piece 27 and an electrode 28. The insulating piece 27 is arranged in the base 26. The anode connecting piece 31 passes through the insulating piece, combines with the electrode 28, and then is fixed on the base 26. The three seal rings are all arranged on the base 26. The first seal ring 23, the second seal ring 24 and the third seal ring 25 cooperate with the glass tube 22, improving the sealing performance, preventing the leakage of the e-liquid. The base 26 is integrated with an upper thread ring, and the whole body can directly serve as a cathode of the meshed heating disc 9 after being electrified.

Another electronic cigarette of the disclosure comprises a cigarette holder assembly B1, an atomization module A1, an e-liquid load module D and a base assembly C1 which are connected in that order.

The cigarette holder assembly B1 comprises a cigarette holder 1, an air adjusting ring 2, a seal ring 3, an upper cover 4, a gas blocking ring 5 and a threaded gasket 6. The seal ring 3 is arranged in a groove of the upper cover 4, the air adjusting ring 2 sleeves the upper cover, the gas blocking ring 5 is screwed up in the threaded gasket 6 and inserted into the upper cover 4. The cigarette holder 1 and the upper cover 4 are in sealing connection, and the flow rate of the airflow and the volume of vapor can be controlled by rotating the air adjusting ring 2 on the top of the cigarette holder assembly.

The atomization module A1 comprises a seal ring 7, an atomizing cover 8, a meshed heating disc 9 comprising a first central hollow 9*a*, e-liquid conducting cotton 10 comprising a second central hollow 10*a*, a cotton support 11, an insulating ring 12, and a fixed ring 13 for fixing the meshed heating disc. The insulating ring 12 is embedded in the cotton support 11, the fixed ring 13 is embedded in the insulating ring 12 for isolating the anode and the cathode, the e-liquid conducting cotton 10 and the meshed heating disc 9 are mounted on the cotton support, and the seal ring 7 is mounted in the groove of the atomizing cover 8, and then is integrated with the cotton support. When the atomization module A1 is electrified, the current is generated from the fixed ring 13, flows to the outer circle from the inner circle of the meshed heating disc 9 and converges with the cathode where the heat is generated. The meshed heating disc 9 is high in power and thus produces a large amount of vapor. The cotton support can be used for fixing the meshed heating disc 9, and can also serve as a contact piece for conducting the cathode. The integrated atomization module is extremely easy to assemble and disassemble, and the atomizing core can be replaced by the user randomly.

The e-liquid load module D comprises an e-liquid feeding hopper 14, a first anode connecting piece 16, a seal ring 17, a spring 18, a telescopic column 19, a second anode connecting piece 20 and an end plug 21. The threaded sleeve 15 is self-existent. The end plug 21 is mounted on the second anode connecting piece 20, the spring 18 is arranged in the telescopic column 19 and is then inserted into the first anode connecting piece 16. The seal ring 17 is embedded in the second anode connecting piece 20, the e-liquid feeding hopper 14 is mounted into the first anode connecting piece 16, the threaded sleeve 15 sleeves the first anode connecting piece, the components are matched with one another to generate upward elastic force, and the elastic force determines the moving up and down of an e-liquid conduction hole in the telescopic column 19, thus opening or closing the e-liquid conduction hole. The end plug 21 cooperates with the second anode connecting piece 20 to prevent the leakage of the e-liquid. The threaded sleeve 15 combines with the anode connecting piece 16 so that the contact of an anode end and the atomization module A1 is firmer. The atomization module A1 can also be replaced directly after the threaded sleeve 15 is dismantled by the user, four ventilation holes are formed in the threaded sleeve 15, which is conducive to improving the flow rate and volume of vapor, and also accelerates the loading of the e-liquid.

The base assembly C1 comprises a glass tube 22, a first seal ring 23, a second seal ring 24, a third seal ring 25, a base 26, an insulating piece 27 and an electrode 28. The structure, function and the combination mode of the components are completely the same as those in the base assembly C and are not explained in detail.

After the scheme is adopted, the components of the electronic cigarette are matched with one another to generate upward elastic force, and the elastic force determines the moving up and down of an e-liquid conduction hole in the telescopic column, thus opening or closing the e-liquid conduction hole. The end plug cooperates with the second anode connecting piece to prevent the leakage of the e-liquid. The cotton support is embedded in the anode connecting piece. The e-liquid conducting cotton, the meshed heating disc and the threaded sleeve cooperate with one another. The threaded sleeve combines with the anode connecting piece so that the contact of the anode end and the meshed heating disc is firmer. The e-liquid conducting cotton and the meshed heating disc can be taken down and replaced directly after the threaded sleeve is dismantled by the user. Four ventilation holes are formed in the threaded sleeve 15, which is conducive to improving the flow rate and volume of vapor, and also accelerates the loading of the e-liquid. The meshed heating disc 9 is circular and made of metal material and contains a composite series-connection and parallel-connection circuit, and the meshed heating disc 9 can enable current to move directionally in the circuit. When the atomization module A1 is electrified, the current is generated from the fixed ring 13, flows to the outer circle from the inner circle of the meshed heating disc 9 and converges with the cathode where the heat is generated. The meshed heating disc 9 is high in power and thus produces a large amount of vapor.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

a cigarette holder assembly;

an atomization module;

an e-liquid load module;

a threaded sleeve; and a base assembly;

wherein the cigarette holder assembly, the atomization module, the e-liquid load module, and the base assembly are connected in that order;

the cigarette holder assembly comprises a cigarette holder, an air adjusting ring, a first seal ring, an upper cover comprising a groove, a gas blocking ring, and a threaded gasket; the first seal ring is arranged in the groove of the upper cover, the air adjusting ring sleeves the upper cover, the gas blocking ring is screwed up in the threaded gasket and inserted into the upper cover; the cigarette holder and the upper cover are in sealing connection;

the atomization module comprises a second seal ring, an atomizing cover, a meshed heating disc, e-liquid conducting cotton, a cotton support, an insulating ring, and a fixed ring for fixing the meshed heating disc; the insulating ring is embedded in the cotton support, the fixed ring is embedded in the insulating ring, the e-liquid conducting cotton and the meshed heating disc are mounted on the cotton support, and the second seal ring is mounted in a groove of the atomizing cover, and then is integrated with the cotton support;

the meshed heating disc and the e-liquid conducting cotton are each in a shape of a flat disc;

the meshed heating disc is stacked on the e-liquid conducting cotton;

the meshed heating disc comprises a first central hollow;

the conducting cotton comprises a second central hollow;

the fixed ring comprises a column;

the column is disposed through the first central hollow and the second central hollow and is in contact with the meshed heating disc;

the e-liquid load module comprises an e-liquid feeding hopper, a first anode connecting piece, a third seal ring, a spring, a telescopic column, a second anode connecting piece and an end plug; the end plug is mounted on the second anode connecting piece, the spring is arranged in the telescopic column and then is inserted into the first anode connecting piece; the third seal ring is embedded in the second anode connecting piece, the e-liquid feeding hopper is mounted into the first anode connecting piece, the threaded sleeve sleeves the first anode connecting piece; the end plug cooperates with the second anode connecting piece to prevent the leakage of the e-liquid; the threaded sleeve combines with the first anode connecting piece; and the base assembly comprises a glass tube, a fourth seal ring, a fifth seal ring, a sixth seal ring, a base, an insulating piece and an electrode; the insulating piece is arranged in the base; the second anode connecting piece passes through the insulating piece, combines with the electrode, and then is fixed on the base; the fourth seal ring, the fifth seal ring, and the sixth seal ring are all arranged on the base; the fourth seal ring, the fifth seal ring, and the sixth seal ring cooperate with the glass tube; the base comprises an upper thread ring integrated with the base, and the upper thread ring serves as a cathode of the meshed heating disc after being electrified.

2. The electronic cigarette of claim 1, wherein the meshed heating disc is made of metal material and contains a composite series-connection and parallel-connection circuit.

3. The electronic cigarette of claim 1, wherein six holes are evenly distributed in a bottom wall of the air adjusting ring.

4. The electronic cigarette of claim 2, wherein six holes are evenly distributed in a bottom wall of the air adjusting ring.

* * * * *